US009636569B2

(12) United States Patent
Karlsen et al.

(10) Patent No.: US 9,636,569 B2
(45) Date of Patent: May 2, 2017

(54) ADJUSTMENT SYSTEM FOR STRAPS ON SNOWBOARD BINDINGS

(71) Applicant: HiTurn AS, Raufoss (NO)

(72) Inventors: Jorgen Karlsen, Hovik (NO); Dennis Dusseldorp, EB Wijk aan Zee (NL); Daniel Kiebert, AH Amsterdam (NL); Cleay Perham, AN Wijk an Zee (NL)

(73) Assignee: HiTurn AS, Raufoss (NO)

( * ) Notice: Subject to any disclaimer, the term of this patent is extended or adjusted under 35 U.S.C. 154(b) by 0 days.

(21) Appl. No.: 14/373,694

(22) PCT Filed: Jan. 24, 2013

(86) PCT No.: PCT/EP2013/051371
§ 371 (c)(1),
(2) Date: Jul. 22, 2014

(87) PCT Pub. No.: WO2013/110725
PCT Pub. Date: Aug. 1, 2013

(65) Prior Publication Data

US 2015/0028553 A1 Jan. 29, 2015

(30) Foreign Application Priority Data

Jan. 26, 2012 (NO) ..... 20120085

(51) Int. Cl.
*A63C 10/06* (2012.01)
*A63C 10/04* (2012.01)
*A63C 10/24* (2012.01)

(52) U.S. Cl.
CPC ..... *A63C 10/06* (2013.01); *A63C 10/04* (2013.01); *A63C 10/24* (2013.01)

(58) Field of Classification Search
CPC ..... A63C 10/04; A63C 10/06; A63C 10/22; A63C 10/24
See application file for complete search history.

(56) References Cited

U.S. PATENT DOCUMENTS 5,143,396 A * 9/1992 Shaanan et al. ..... 280/607
5,758,895 A * 6/1998 Bumgarner ..... 280/607
(Continued)

FOREIGN PATENT DOCUMENTS

AT 5877 U1 1/2003
DE 20 2005 019273 U1 3/2006
(Continued)

OTHER PUBLICATIONS

International Search Report for corresponding International Patent Application No. PCT/EP2013/051371 mailed Apr. 17, 2013.
(Continued)

*Primary Examiner* — Emma K Frick
(74) *Attorney, Agent, or Firm* — Merchant & Gould P.C.

(57) ABSTRACT

The invention consist of a tool-less system applied for adjusting the wrist-strap and the toe-strap on snowboard bindings, where such tool-less system is made up with the combination of 3 elements, 1. It is tool-less so the attachment position of the binding strap can be unlocked from one position on the binding frame and locked into another position fairly easily with bare hands 2. It has a stable locking mechanism based on a profiled press-button/pin element fitting into at least one hole with profiled shape provided in the frame of the binding where also at least one hole provided in the strap(s) will fit in and be securely locked in when the button element is put in place 3. The press-button element is put in place from the inside and prevented from popping out during use also by the boot which blocks the only exit direction for the button element, which is inwards. The wrist-strap will further be prevented from popping out by the highback, which during riding covers the button element holding the wrist-strap in place. The toe-strap may further be prevented from popping out by the base-plate.

15 Claims, 6 Drawing Sheets

(56) References Cited

U.S. PATENT DOCUMENTS

Figure 1:
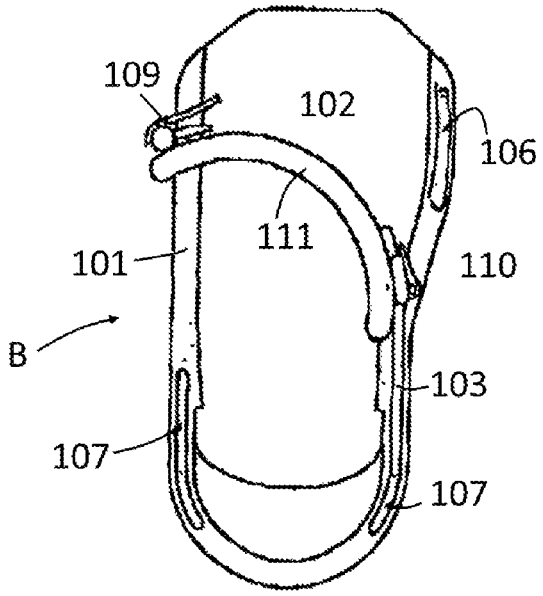
Prior Art FIG. 1

| | | | | |
|---|---|---|---|---|
| 6,056,300 | A * | 5/2000 | Carpenter et al. | 280/14.22 |
| 6,113,114 | A * | 9/2000 | Zemke et al. | 280/14.26 |
| 6,283,491 | B1 * | 9/2001 | Bush et al. | 280/611 |
| 6,416,075 | B1 * | 7/2002 | Laughlin et al. | 280/624 |
| 6,604,746 | B1 * | 8/2003 | Sato et al. | 280/14.22 |
| 6,773,020 | B2 * | 8/2004 | Gonthier | 280/14.21 |
| 6,974,149 | B2 * | 12/2005 | Naito | A63C 10/04 280/14.22 |
| 7,232,147 | B2 * | 6/2007 | Couderc | 280/623 |
| 7,374,194 | B2 * | 5/2008 | Naito et al. | 280/611 |
| 7,614,638 | B2 * | 11/2009 | Cunningham et al. | 280/617 |
| 2001/0009320 | A1 * | 7/2001 | Couderc et al. | 280/14.24 |
| 2002/0190502 | A1 | 12/2002 | Naito et al. | |
| 2002/0190503 | A1 | 12/2002 | Laughlin et al. | |
| 2003/0098569 | A1 * | 5/2003 | Gonthier | 280/623 |

FOREIGN PATENT DOCUMENTS

| | | | |
|---|---|---|---|
| DE | 202005019273 | * | 3/2006 |
| FR | 2 879 940 A1 | | 6/2006 |

OTHER PUBLICATIONS

International Preliminary Report on Patentability for corresponding International Patent Application No. PCT/EP2013/051371 mailed May 13, 2014.

Norwegian Search Report for Norwegian Patent Application No. 20120085 mailed Jul. 2, 2012.

* cited by examiner

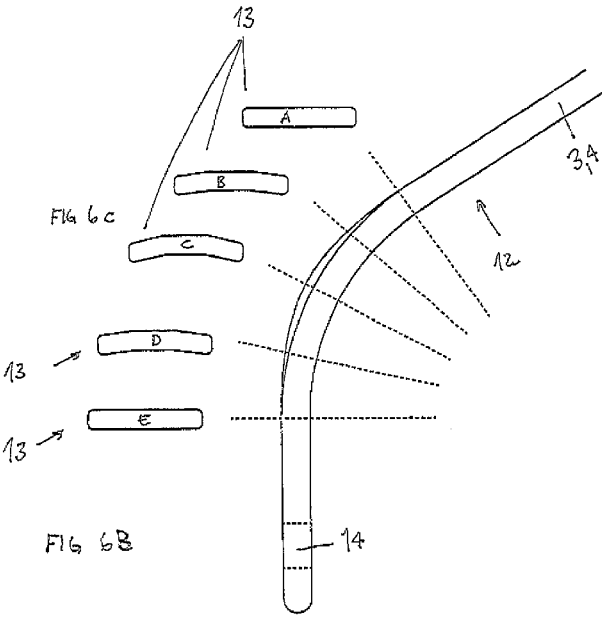
FIG 6c
FIG 6B
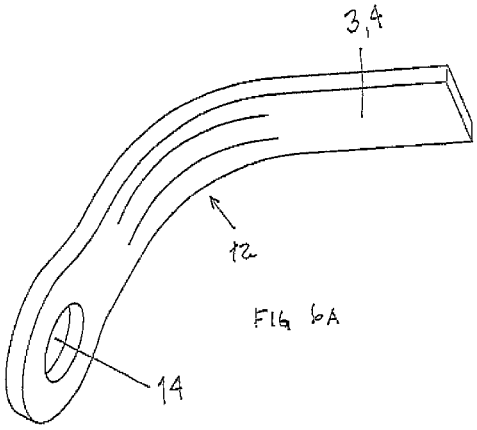
FIG 6A

ADJUSTMENT SYSTEM FOR STRAPS ON SNOWBOARD BINDINGS

This application is a National Stage Application of PCT/EP2013/051371, filed 24 Jan. 2013, which claims benefit of serial No. 20120085, filed 26 Jan 2012 in Norway and which applications are incorporated herein by reference. To the extent appropriate, a claim of priority is made to each of the above disclosed applications.

The present invention concerns bindings for snowboards, where the bindings come in pairs which are attached to fixation devices in the snowboard, and more particularly the present invention concerns how such bindings can be adjusted.

Because different snowboard riders have different types and sizes of boots, and also different riding styles, they have different wishes for how the binding on their board should be adjusted in order to provide the best riding experience for them. Almost all types of bindings allow for some adjustments of highback, binding straps etc. Most commonly the rider will loosen one or more screws with a screwdriver and then move and/or adjust one or more parts of the binding, and then tighten the screw(s) again, thus having made the desired adjustment.

An object of the present invention is to provide a binding for a snowboard which can be adjusted in an easy way.

It is further an object of the present invention to provide a binding for a snowboard which is economical and simple to manufacture.

These objectives are achieved with a binding for a snowboard provided with an adjustment system for straps on a snowboard binding according to the invention as defined in the enclosed independent claim, where embodiments of the invention are given in independent claims.

The present invention seeks new ways to achieve adjustments of the binding straps for the desired position on a binding frame of the binding without the need of a screwdriver or any other tools. The invention consist of the combination of 3 elements, 1. It is tool-less so the attachment position of the binding strap can be unlocked from one position on the binding frame and be locked into another position fairly easily with your bare hands,
2. It has a stable locking mechanism based on a profiled press in system, such as press-button/pin fitting or the like, into at least one hole with profiled shape provided in the binding frame of the binding Where also at least one hole provided in the binding strap will fit in and be securely locked in when the press-button/pin is put in place, and
3. The press-button/pin is put in place from the inside and prevented from popping out during use also by the boot which blocks the only exit direction for the button, which is inwards.

One may assume that the press in system, for instance press-button/pin locking systems are less secure than screws. However, screws tend to come loose over time by vibrations during use, and the press-button/pin locking systems described by our invention takes measures to ensure the durability of the locking position. The one or more press-buttons that are used and the corresponding hole or holes in the binding have certain locking mechanisms by themselves, and in addition to that they are blocked from popping out while the boot is strapped in its normal riding position. This will prevent the locking-button from falling out during use, which is the most critical since it concerns the safety of the rider.

The press-button locking system of this making can be applied for both toe-straps and wrist-straps.

For wrist-straps the press-button/pin systems offers an additional safety feature against the press-button(s) popping out. The one or more press-buttons are put in place while the highback of the binding is moved forward from its normal position, i.e. a position where the highback is arranged to be resting on a heel stay of the binding. When the highback has been put back in place, it covers the press-button(s) and will prevent the press-button from falling out, even if there is no boot present, and the system is then further stabilized when the boot is being strapped tightly into the binding, allowing very little space for any movement of the press-button(s). Such a combined enhanced secure locking system at the wrist-strap is seen as clearly advantageous, and it only requires flipping the highback forwards, so it comes at no extra effort when changing the wrist-strap's position.

For toe-straps the press-button/pin systems may offer an additional safety feature against press-button(s) popping out. The hole or holes for the press-buttons/pins may be placed rather close to the bottom of the binding frame, and the press-button(s) are then put in place while a floor plate of the binding is moved out from its normal position. When the floor plate has been put back in place, it covers partly the one or more press-buttons and will prevent the button(s) from falling out, even if there is no boot present, and the system is then further stabilized when the boot is being strapped tightly into the binding, allowing very little space for any movement of the press-button(s). Such a combined enhanced secure locking system at the toe-strap is seen as advantageous, even though it require the removal of the base-plate while adjusting the toe-strap's position. This solution may also require a slight modification of a base plate of the binding to make it cover a part of the press button(s) if the hole(s) cannot be placed low enough.

There are safety aspects with straps that the present invention does not address, like straps simply breaking, or buckles that opens during riding. The goal of the present invention is to secure the aspect where the changes occur relative to existing systems.

The straps themselves may be made as most straps are made in order to fit the position when they are closed in over the boot in order to lock the boot in this position. However, we find it beneficial to make a special profile in the straps which make them bend away from the bindings when open. The reason for this is to make it easier to put the bindings back on for the next ride, and especially it is easier for the rider to put his free boot in the binding while riding out of the ski-lift. Straps that bend outwards are known, but we here introduce a special profiled reinforcement of the strap which to a greater extent makes the strap stay in the desired position without having to use extra amounts of material. It is also a point that the straps must not be too strongly bent outwards, since when the boot is buckled in, the straps must fold nicely over the boot without causing problems because of its special shape. It is especially the wrist-strap which holds the wrist-padding that gives the most benefits to bend out, but also the wrists tooth-strap on the opposite side and the toe-straps can be bent out to allow easier access to the binding.

Generally about straps that are used in connection with bindings: each binding comprises usually four straps, corresponding left and right wrist-straps, and corresponding left and right toe-straps, whereby a pair of bindings then has 8 straps. Between a pair of corresponding straps is arranged a padding. One of the straps of the corresponding left and right wrist-straps and toe-straps will then be permanently fixed to one end of the padding (the strap may still be adjustable, but not adjusted every time the rider buckles in). On its opposite side, towards its end the padding has a buckle into which the rider puts the other corresponding strap and tightens it with the buckle. The strap which goes into the buckle is usually a tooth-strap in order to allow the buckle to tighten it. A person skilled in the art would know how the different straps and buckle should be designed, and this is therefore not discussed further herein.

An important element of the present invention is how the one or more holes in the binding frame and the one or more locking-buttons them self are designed to assure that they stay in position during riding. One aspect is the profiles of the press-button(s) being slightly larger than the corresponding hole(S) in the binding frame.

Another aspect that helps keep the press-button(s) in place is that one may make the radius of the press-button smaller than the hole just where the strap fits in. Then when the strap is tightened, it will keep the press-button(s) in place. The reduction in radius can be rather moderate and still achieve a significant difference. To prevent breaking issues, it is also an option that the core of the press-button(s), normally being made of plastic, may be made of metal.

The invention shall now be described further through a few of several possible examples which fit the above description. Whether one uses this system just for wrist-straps or just for toe-straps or for both on a specific binding is a matter of choice. Press-buttons/pins for more than 3 holes are also possible.

Figure 2:
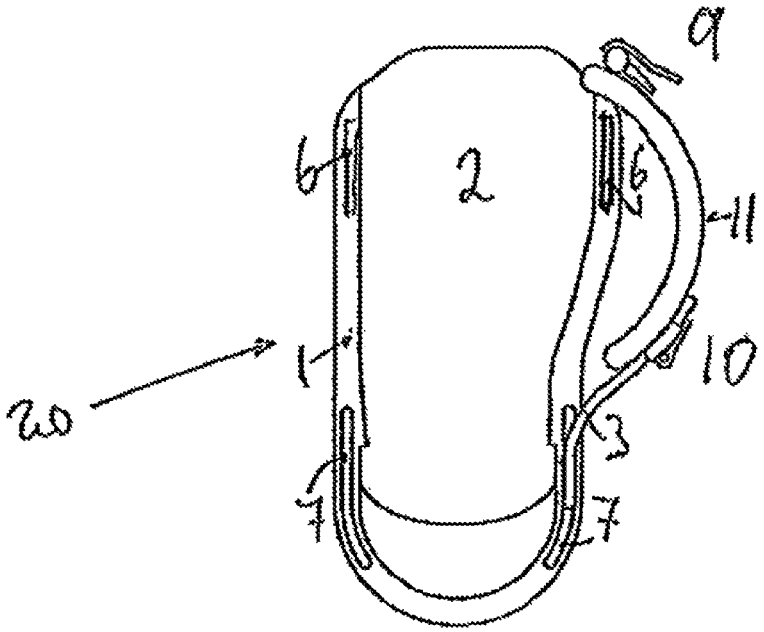
Figure 3A:
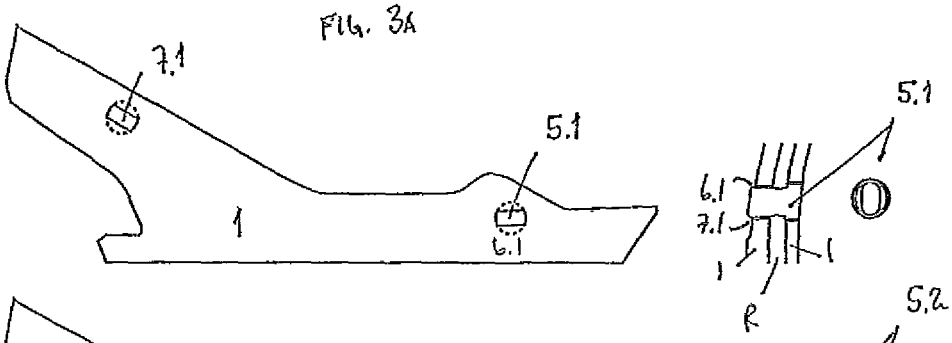
Figure 3B:
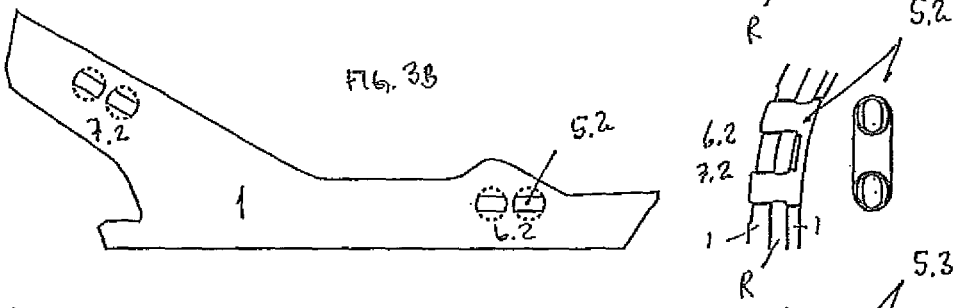
Figure 3C:
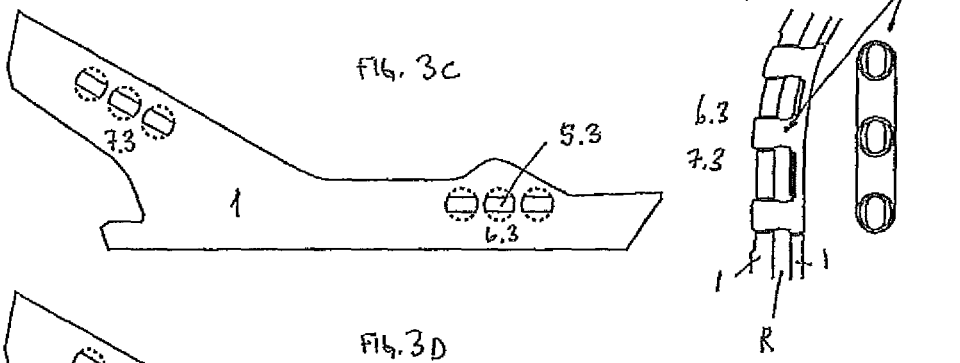
Figure 3D:
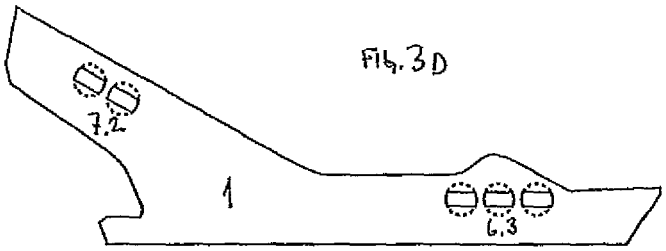
Figure 3E:
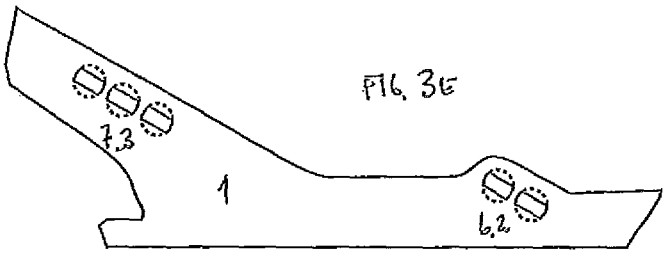
Figure 4A:
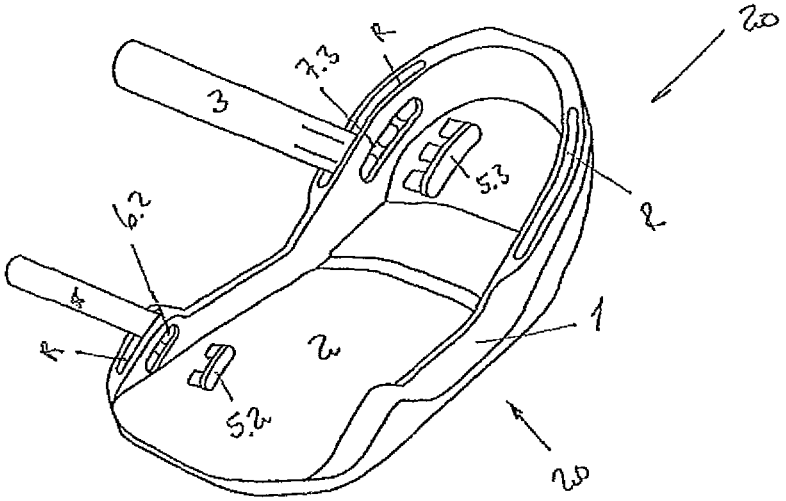
Figure 4B:
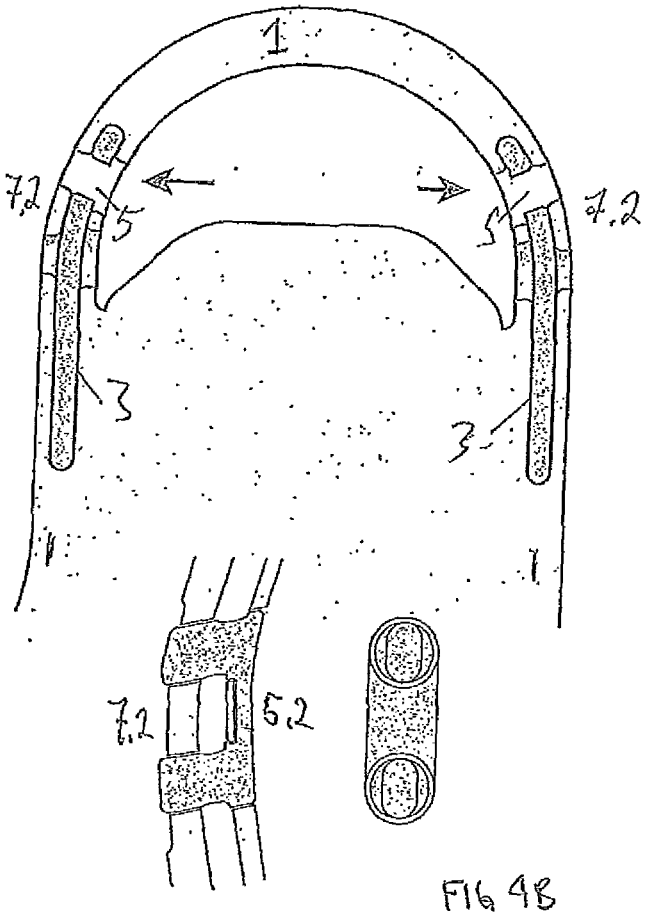
Figure 5A:
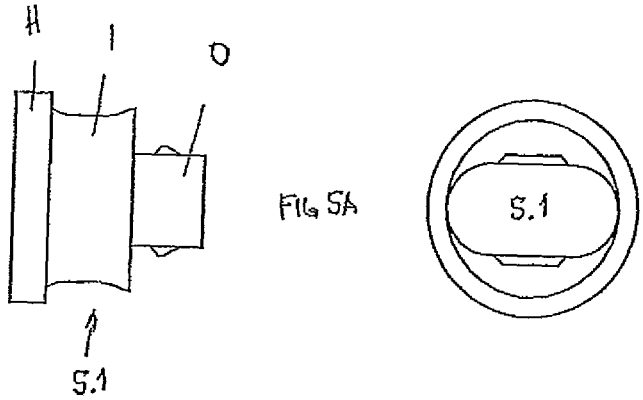
Figures 5B, 5C, 5D, 5E:
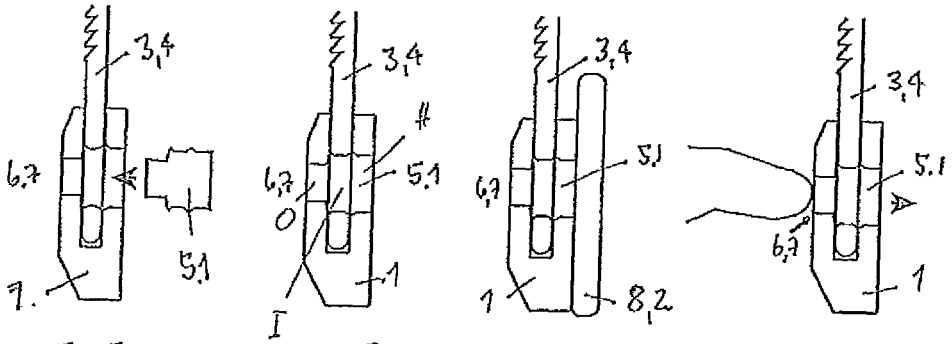
Figure 7:
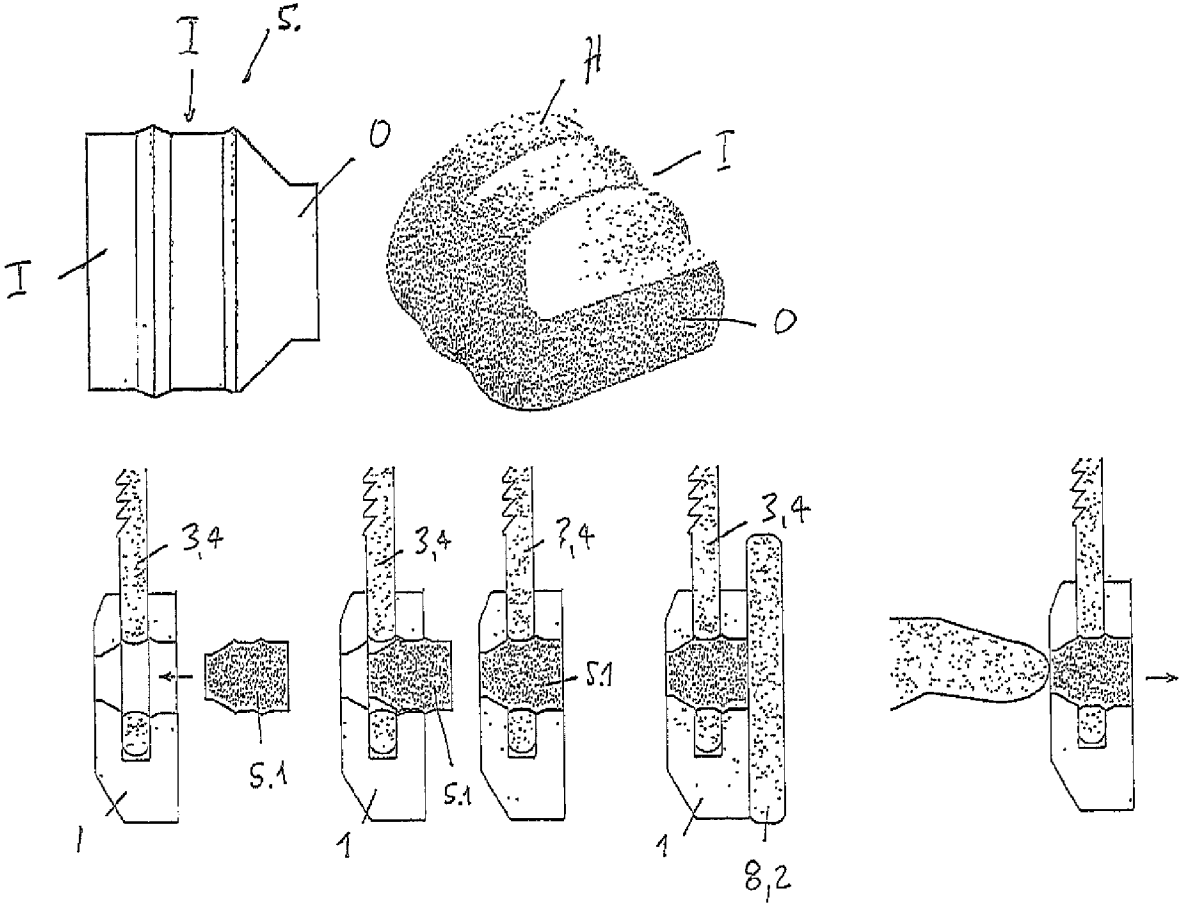

The foregoing and other objects, features and advantages of the invention will be apparent from the following more particular description of preferred non-limiting embodiments of the invention, as illustrated in the accompanying drawings where:

FIG. 1 shows a top view of a prior art binding, where only a normally curved wrist-strap with a wrist-padding attached thereto is shown, FIG. 2 shows the binding with an adjustment system according to the present invention 1, where the wrist-strap is shown in an outwardly bent position, FIGS. 3A-3E show different embodiments of a binding, where the binding is provided with alternative attachment point(s) for the wrist-straps and toe-straps, a cross-section of the attachment point(s) and inserted press-button(s) and a top view of the press-button(s), FIG. 4A shows a view of an embodiment of a binding with right side wrist-strap and right side toe-strap, where the binding frame is provided with two different attachment points available for the wrist-strap and three different attachment points for the toe-strap, FIG. 4B shows, from above, a rear part of a binding, where the wrist-strap is attached to a trailing position of the attachment points available for the wrist-strap by press-button(s), FIG. 5A shows the general profile for a single press-button of the press-button system seen in side view (left) and from the top (right). The profiles will be the same for press-buttons provided for two holes and press-buttons provided for three holes. A press-button for two holes may also fit the binding frame that is provided with three holes, FIG. 5B shows the press-button according to FIG. 5A, before it is pressed in to the shown position with the straps also in position, FIG. 5C shows the press-button according to FIG. 5A, after it is pressed in to the shown position with the straps also in position FIG. 5D shows the press-button according to FIG. 5A, with the highback or base-plate in position, preventing any pop-out of the press-button FIG. 5E shows how to press the press-button according to FIG. 5A out after first tilting the highback away or removing the base-plate, FIG. 6A shows the special profile of a wrist-strap or toe-strap, for instance the wrist-strap according to FIG. 2, FIG. 6B shows the strap according to FIG. 6A, from the side view with marks for different cross-sections, FIG. 6C shows three different cross sections of the strap according to FIG. 6A, where the amount of angle on the profile used will depend on material and thickness of the strap, here is just shown one possible making, and FIG. 7 shows much the same as FIG. 5, only with a different making of the press-button.

In FIG. 1 is shown a prior art binding B for a snowboard (not shown), where the binding comprises a binding frame 101, a base plate 102 and a traditional wrist-strap 103. It is also indicated that the binding frame 101 is provided with holes 106 for attachment of a toe-strap (not shown). One end of a wrist-padding 111 is in a suitable manner connected to the wrist-strap 103, while the opposite end of the wrist-padding 111 is connected to a buckle 109. The buckle 109 is used to connect a corresponding wrist-strap (not shown) with the wrist-strap 103, whereby the two wrist-straps can be adjusted and locked relative each other.

As can be seen, this prior art binding will provide a strap system where the wrist-strap when not in use, will fall into the binding frame 101. This will result in that it will be difficult to set a boot into the binding B again, without removing the wrist-strap 103 from the binding frame 101.

In FIG. 2 is shown a binding 20 according to the present invention, where the binding 20 also is provided with one or more holes 6, 7 for a pair of corresponding toe-straps (not shown) and a pair of corresponding wrist-straps (only the right hand wrist-strap 3 is shown), where the wrist-strap 3 is connected to the wrist-padding 11. However, the wrist-strap 3 is provided with a curved design, where the curved design of the wrist-strap 3 will result in that the wrist-strap 3 will be positioned as shown in FIG. 2 when the right wrist-strap 3 is released from the corresponding left wrist-strap (not shown). The design of the wrist-strap 3 will therefore provide a solution where the base plate 2 of the binding 20 is held free. The snowboard river will therefore not have to remove the base plate 2 before the boot is placed into the binding 20 again.

FIGS. 3A-3E shows how the binding frame 1 of the binding 20 can be designed with attachment points 6 for the toe-strap 4 (see also FIG. 4A) or attachment points 7 for the wrist-strap 3 (see also FIG. 4A). The attachment points 6, 7 are then at least one through hole provided in the binding frame 1. The wrist-straps 3 and toe-straps 4 are then provided with one or more corresponding through holes. The binding frame 1 can then be provided with a single hole 6.1, 7.1 for both the wrist-straps 3 and toe-straps 4 as shown in FIG. 3A or double holes 6.2, 7.2 or triple holes 6.3, 7.3, as shown in FIGS. 3B and 3C, respectively. The wrist-straps 3 and toe-straps 4 will then be guided into recesses R provided on each side of the binding frame 1 (see also FIG. 4A), where the recesses R extend a length down into the binding frame 1, and where the through holes 6, 7 are provided through the recesses R and the binding frame 1.

In FIGS. 3D and 3E are shown embodiments of the binding 20, where the binding frame 1 is provided with double holes 7.2 for the wrist-straps 3 and triple holes 6.3 for the toe-straps 4 (FIG. 3D), while the embodiment shown in FIG. 3E is provided with triple holes 7.3 for the wrist-straps 3 and double holes 6.2 for the toe-straps 4. In addition to this, it can be seen that the double holes 6.2 for the toe-straps 4 in this embodiment are angled relative the binding frame 1.

On right sides of FIGS. 3A-3C are shown, in cross-section, how a press-button element 5 (see also FIG. 5A or 7) is used to secure the wrist-straps 3 and toe-straps 4 to the binding frame 1, where the press-button element 5 then can comprise one pin (FIG. 3A), two pins (FIG. 3B) or three pins (FIG. 3C).

FIG. 4A is a perspective view of the binding 20 according to the present invention, where it can be seen how the wrist-strap 3 and toe-strap 4 are guided into the corresponding recess R, where a press-button element 5.3 with three pins is to be pushed into the triple holes 7.3 in order to secure the wrist-strap 3 to the binding frame 1, while a press-button element 6.2 with two pins is to be pushed into the double holes 6.2 in order to secure the toe-strap 4 to the binding frame 1. However, it is to be understood that also a press-button element 6.2 with two pins can be used to secure the wrist-strap 3 to the binding frame 1.

FIG. 4B shows from above details of the binding frame 1, where it can be seen how the wrist-straps 3 can be secured to the binding frame 1. In this embodiment it is shown that the attachment point 7 is provided as double holes 7.2, where a press-button element 5 with a single pin is used to secure the wrist-straps 3 to the binding frame 1. This arrangement will result in that the wrist-straps 3 can be adjusted to a greater extend, as the through hole in the wrist-straps 3 that is shown used to secure the wrist-straps 3 to the binding frame 1, can be moved to the foremost hole of the double holes 7.2, whereby the press-button element 5 with one pin can be used to secure the wrist-straps in this position. However, it should be understood that also a press-button element 5 with two pins can be used to secure the wrist-straps 3 instead of the press-button 5 with one pin.

FIG. 5A shows the design of the press-button element 5, where the press-button element 5.1 for the sake of simplicity is provided with one pin. Left side of figure shows the press-button element 5.1 in a side view, while the right side shows the press-button 5.1 from above. The press-button element 5.1 is provided with a head section H, an intermediate section I and an outer section O. The head section H will then be in line with an inner side of the binding frame 1 when the press-button element 5 is pushed into the attachment point 6, 7, while the outer section O will be in line with an outer side of the binding frame 1 (see also FIG. 4A). The intermediate section I will then lock and secure the wrist-straps 3 and toe-straps 4 to the binding frame 1.

FIGS. 5B-5E show the press-button element 5.1 in different positions, where FIG. 5B show the press-button 5.1 before it is used to secure the wrist-straps 3 and toe-straps 4 to the binding frame 1, FIG. 5C shows the press-button element 5.1 after it has been pressed into the attachment points 6, 7, thereby securing the straps 3, 4 to the binding base, FIG. 5D shows the press-button element 5.1 in the same position as shown in FIG. 5C, where a highback 8 or base plate 2 is brought into a ready to use position, thereby covering at least a part of the press-button element 5.1, preventing the press-button element 5.1 to "pop-out" unintentionally. FIG. 5E shows how to press out the press-button element 5.1, first tilting the highback 8 away or removing the base plate 2. The press-button element 5.1 is pressed out of the binding frame 1 from the outside of the binding frame 1. A person skilled in the art would understand that the profiles of the press-button(s) 5 must be slightly larger than the corresponding attachment points (holes) 6, 7 provided in the binding frame 1 in order to assure that the pressure-button element stay in position during riding with the snowboard.

FIG. 6A shows in greater detail the design or profile 12 of the wrist-strap 3 according to FIG. 2. However, it should be understood that also the toe-strap 4 can be made with this design. The wrist-strap 3 (or toe-strap 4) is at one end provided with a through hole 14, where the press-button element 5 is guided through this hole 14 in order to secure the wrist-strap 3 or toe-strap 4 to the binding frame 1. At a distance from the hole 14, the wrist-strap 3 and/or toe-strap 4 is bent with a certain angle, where this bending will provide a solution where the base plate 2 of the binding 20 is held free.

In FIG. 6B the wrist-strap 3 (or toe-strap 4) is shown in a side view with marks for the different cross-sections, before, through and after the bend. The different cross-sections for the marks are shown in FIG. 6C, where it can be seen that cross-sections A and E will have the same design of the cross-sections, cross-sections B and D will have the same design of the cross-sections (the cross-sections have a certain curvature), while cross-section C will have a even more pronounced curvature. How the thickness, curvature, which material should be chosen etc. will depend on different parameters and a person skilled in the art would know how to solve this.

FIG. 7 show a press-button element 5 according to FIGS. 5A-5E, but with a different profile, where the press-button element 5 is shown in the different positions as explained in FIG. 5A-5E.

The present invention has now been explained by means of preferred embodiment. Only elements connected to the invention are described and a person skilled in the art will appreciate that the press-button element(s), attachment point and wrist-straps and toe-straps etc. are to be adapted to the specific use of the binding. The person skilled in the art will also understand that several changes and/or modifications may be made to the described and illustrated embodiments which are within the scope of invention as defined in the following claims.

DETAILS FROM THE FIGURES

1) Binding Frame
2) Base Plate
3) Wrist-strap
4) Toe-strap
5) Press-button/pin element for locking the straps in position
6) Hole(s) in binding frame for toe-strap
7) Hole(s) in binding frame for wrist-strap
8) Highback
9) Buckle for daily use
10) Buckle for rare use
11) Wrist-padding
12) Profiled strap with outward bend
13) Cross section of profiled strap
14) Hole(s) in strap for attachment by press-button

The invention claimed is:

1. A binding for a snowboard, the binding comprising a binding frame coupled with a base-plate, one or more binding straps, and a strap adjustment system removably coupling each of the binding straps to the binding frame, the binding frame comprising an inside and an outside, wherein the strap adjustment system comprises:

I. a plurality of attachment points, each attachment point comprising at least one hole extending through the binding frame;

II. locking mechanism comprising a press-button element having a head section, an intermediate section, and an outer section, wherein the press-button element is constructed to fit into the at least one hole of the attachment points, wherein the press-button element is constructed to be inserted and removed through the inside of the binding frame and without using tools, and wherein when the press button element is in an inserted position in one of the holes of the plurality of the attachment points, the head section is aligned with the inside of the binding frame and the outer section is aligned with the outside of the binding frame such that the press-button element does not protrude beyond the inside and the outside of the binding frame; and III. at least one hole on each of the one or more binding straps, wherein each of the holes on the one or more binding straps corresponds to a hole on one of the attachment points when an end of one of the binding straps is positioned into the binding frame so that the press-button element mates with the hole on one of the attachment points and the corresponding hole on the binding strap positioned into the binding frame when the holes are aligned, and the binding strap is securely locked in when the press-button element is inserted through the aligned holes from the inside of the binding.

2. A binding for a snowboard according to claim 1, wherein the binding further comprises a highback.

3. A binding for a snowboard according to claim 2, wherein the highback comprises a normal position and a forward position, and wherein the highback is tilted to the forward position while the press-button element is installed, and wherein in the normal position the highback blocks the press-button element from popping out.

4. A binding for a snowboard according to claim 1, wherein the base-plate is removable, and wherein the base-plate is removed while the press-button element is installed, and when the base-plate is coupled with the binding frame, the base plate blocks the press-button element from popping out.

5. A binding for a snowboard according to claim 1, wherein the press-button element is made of a resilient material allowing it to be pressed into position with a moderate force, and wherein the press-button element has a perimeter that is bigger than the at least one hole extending through the binding frame.

6. A binding for a snowboard according to claim 1, wherein the head section is constructed to couple with one of the holes on the binding frame and the intermediate section is constructed to couple with one of the holes on the binding strap positioned in the binding frame, and wherein the intermediate section comprises a smaller radius than the head section thus providing a grip-point for the binding strap positioned in the binding frame to lock the press-button element when the binding strap positioned in the binding frame is tightened.

7. A binding for a snowboard according to claim, 1, wherein the press-button element comprises one pin, two pins or three pins, which is/are inserted from the inside.

8. A binding for a snowboard according to claim 1, wherein the press-button elements are made of plastic material, or plastic material with a metal core.

9. A binding for a snowboard according to claim 1, wherein at least one of the binding straps comprises a profiled strap constructed to bend outwards from the binding when not in use.

10. The binding of claim 9, wherein the profiled strap comprises a cross sectional profile having a curve transverse to a longitudinal direction of the profiled strap.

11. The binding of claim 1, wherein the binding comprises two binding straps, and wherein the two binding straps are independently adjustable.

12. The binding of claim 1, wherein at least one of the plurality of attachment points comprises two or more holes extending through the binding frame, and wherein the holes are positioned in a row generally aligned with a bottom edge of the binding frame.

13. The binding of claim 1, wherein at least one of the plurality of attachment points comprises two or more holes extending through the binding frame, and wherein the holes are positioned in a row generally aligned with a top edge of the binding frame.

14. The binding of claim 1, wherein the strap adjustment system allows for adjustment of a position of the one or more binding straps in a front-to-back direction.

15. The binding of claim 1, wherein the binding frame at each attachment point comprises an inner wall and an outer wall separated by a gap, and wherein the hole extending through the binding frame comprises a hole extending through the inner wall and a hole extending through the outer wall, and wherein the press-button element comprises a profile comprising a first perimeter at the head section, a second perimeter at the intermediate section, and a third perimeter at the outer section, and wherein the first and third perimeters are different from the second perimeter.

* * * * *